US005742116A

United States Patent [19]

Maki et al.

[11] Patent Number: 5,742,116

[45] Date of Patent: Apr. 21, 1998

[54] SHADOW MASK FRAME STRUCTURE WITH LONG-SIDES HAVING HIGHER MECHANICAL STRENGTH

[75] Inventors: Hideaki Maki; Jun Araya; Mayumi Ishibashi, all of Osaka; Takami Okamoto, Kyoto, all of Japan

[73] Assignee: Matsushita Electronics Corporation, Osaka, Japan

[21] Appl. No.: 547,306

[22] Filed: Oct. 24, 1995

[30] Foreign Application Priority Data

Oct. 28, 1994 [JP] Japan ..... 6-265081
Oct. 31, 1994 [JP] Japan ..... 6-267007

[51] Int. Cl.[6] ..... H01J 29/81

[52] U.S. Cl. ..... 313/402; 313/404; 313/405; 313/407

[58] Field of Search ..... 313/402, 404, 313/405, 407

[56] References Cited

U.S. PATENT DOCUMENTS

| | | | |
|---|---|---|---|
| 4,069,567 | 1/1978 | Schwartz | 29/25.15 |
| 4,333,034 | 6/1982 | Ohgoshi et al. | 313/407 |
| 4,437,036 | 3/1984 | Ragland, Jr. | 313/402 |
| 5,218,267 | 6/1993 | Ragland, Jr. | 313/407 |
| 5,532,546 | 7/1996 | Horiuchi | 313/407 |
| 5,550,428 | 8/1996 | Kume et al. | 313/402 |

FOREIGN PATENT DOCUMENTS

| | | |
|---|---|---|
| 0 228 110 | 7/1987 | European Pat. Off. . |
| 0 602 620 | 6/1994 | European Pat. Off. . |
| 2-204943 | 8/1990 | Japan . |
| 3-187132 | 8/1991 | Japan . |
| 2 001 193 | 7/1978 | United Kingdom . |
| 2 240 59 | 8/1991 | United Kingdom . |
| 2240659 | 8/1991 | United Kingdom . |

OTHER PUBLICATIONS

Copy of European Search Report dated Mar. 4, 1996.

Publication No. JP 3–187132, dated Aug. 15, 1991, Patent Abstracts of Japan, vol. 15, No. 442, Nov. 11, 1991.

Publication No. JP 4–092337, dated Mar. 25, 1992, Patent Abstracts of Japan, vol. 16, No. 318, Jul. 13, 1992.

Publication No. JP 2–204943, dated Aug. 14, 1990, Patent Abstracts of Japan, vol. 14, No. 493, Oct. 26, 1990.

Publication No. JP 55–86049, Patent Abstracts of Japan, vol. 4, No. 133, Sep. 18, 1990.

*Primary Examiner*—Sandra L. O'Shea
*Assistant Examiner*—Vip Patel
*Attorney, Agent, or Firm*—Merchant, Gould, Smith, Edell, Welter & Schmidt, P.A.

[57] ABSTRACT

In a color cathode ray tube apparatus, a shadow mask is fixed on a frame with a predetermined tension for cancelling a thermal expansion of the shadow mask during normal operation of the color cathode ray tube apparatus. The mechanical strength of the longer sides on the frame is higher than that of the shorter sides of the frame by fixing reinforcing plates or ribs on the longer sides in order that the tension of the shadow mask not become uneven.

30 Claims, 18 Drawing Sheets

SHADOW MASK FRAME STRUCTURE WITH LONG-SIDES HAVING HIGHER MECHANICAL STRENGTH

FIELD OF THE INVENTION

This invention relates to a cathode ray tube apparatus, and especially relates to a cathode ray apparatus having a shadow mask which is fixed on a frame under a condition that a predetermined tension is applied to the shadow mask.

BACKGROUND OF THE INVENTION

In a flat type color cathode ray tube apparatus, about 80% of electron beams which are emitted from electron guns collide with a shadow mask. The shadow mask is heated by the collision of the electron beams, and it is deformed by thermal expansion. In order to prevent the reduction of the quality of picture images displayed on a screen of the cathode ray tube apparatus caused by the deformation of the shadow mask, the shadow mask has been fixed on a frame under a condition that a predetermined tension is applied to the shadow mask in the conventional color cathode ray tube apparatus.

The frame of the conventional color cathode ray tube apparatus is integrally formed from a plate by press working in order to make a cross-sectional shape of each side substantially L-shaped. Alternatively, the frame is formed by welding of four angle bars having a substantially L-shaped cross-section in order to make each angle between the sides be substantially right angle. Therefore, an electron beam through hole on the frame is formed as a substantially rectangular shape. At the same time, the manufacturing process of the frame can be made simple and the cost of the frame can be reduced.

On the other hand, when the rigidity of the frame is not sufficient, the frame will be deformed by the tension applied to the shadow mask. Thereby, the surface of the shadow mask corrugates. Furthermore, the relative positions of electron beam through holes on the shadow mask against phosphor regions on the screen are discrepant. Thus, the mislanding occurs on the color cathode ray tube apparatus. For preventing the deformation of the frame, as shown in Publication Gazette of Unexamined Japanese Patent Application Hei 3-187132, the cross-sectional shape of each side of the frame is made to be substantially triangular for increasing the rigidity of the frame.

Furthermore, in the shadow mask which is fixed on the frame with the predetermined tension, the tension should be larger to cancel the thermal expansion of the shadow mask sufficiently, for preventing the mislanding due to the thermal expansion of the shadow mask, when the shadow mask is heated by the irradiation of the electron beams during operation of the color cathode ray tube apparatus. Therefore, the frame is made of a material having a larger thermal expansion coefficient than that of the material of the shadow mask, which is, for example, shown Publication Gazette of Unexamined Japanese Patent Application Hei 2-204943.

In the flat type color cathode ray tube apparatus, the aspect ratio is, for example, 3:4 or 9:16, so that the screen or the frame is horizontally oblong. Thus, when the shadow mask is fixed on the frame by welding with the predetermined tension in the manufacturing process, quantities of the strain of the longer side and the shorter side are different from each other. Therefore, the tension which is applied to the shadow mask becomes uneven. As a result, the mislanding will occur due to the discrepancy between the electron beam through holes on the shadow mask and the phosphor regions on the screen by the thermal expansion of the shadow mask during operation of the color cathode ray tube apparatus.

Furthermore, since the tension along the longer side is larger, the longer sides of the frame warp inward. At the same time, the shorter sides warp outward. For preventing the interlocking of the warp of the longer sides and the shorter sides, it is proposed that cuttings are provided on respective corners of the frame for warping the longer sides and the shorter sides independently, which is, for example, shown in Publication Gazette of Unexamined Japanese Patent Application Hei 5-290754. However, when the cross-section of each side of the frame is of triangular shape, a reinforcing plate is to be obliquely welded between a side wall perpendicular to the shadow mask face and a flange parallel to the shadow mask face. Alternatively, each side member of the frame is formed by bending a plate to provide a substantially triangular cross-section or formed by cutting a bar having a substantially triangular cross-section, and the side members are welded at four corners of the frame. By such a configuration, the frame has disadvantages in that the weight of the frame becomes heavier and the working process of the frame become complex, and the cost for manufacturing the frame becomes expensive. Furthermore, when the cuttings are provided on respective corners of the frame, the tension applied to the shadow mask will be uneven in the vicinity of the cuttings. Thus, the corrugation occurs in those parts, and the corrugation becomes the cause of the mislanding of the picture image displayed on the screen of the color cathode ray tube apparatus.

Furthermore, in a heat treatment of the manufacturing process of the color cathode ray tube apparatus, plastic deformation occurs in the shadow mask. Thus, the tension which is applied to the shadow mask is reduced. Generally, a temperature of the shadow mask in a normal actuation of the color cathode ray tube apparatus is about 100 degrees Celsius. On the other hand, the highest temperature of the shadow mask in the heat treatment is about 450 degrees Celsius. As mentioned above, the frame is made of the material having larger thermal expansion coefficient than that of the material of the shadow mask for preventing the reduction of the tension applied to the shadow mask. Since the temperature of the shadow mask and the frame in the heat treatment in the manufacturing process becomes about five times as large as the temperature in the normal operation of the cathode ray tube apparatus, the difference between the thermal expansion of the shadow mask and the thermal expansion of the frame is magnified. Thus, the tension applied to the shadow mask will be larger that that in the normal actuation of the color cathode ray tube apparatus or the ordinary temperature. As a result, the plastic deformation occurs in the shadow mask. The tension applied to the shadow mask in which the plastic deformation occurs will be reduced at the ordinary temperature, and the mislanding will occur during operation of the color cathode ray tube apparatus.

SUMMARY OF THE INVENTION

An objective of this invention is to provide an improved color cathode ray tube apparatus, in which the tension applied to the shadow mask is uniform in each direction after the welding of the shadow mask on the frame. Another objective of this invention is to provide an improved cathode ray tube apparatus, in which no corrugation occurs on the shadow mask even when the shadow mask is welded on the frame with a predetermined tension, and the weight of the frame is not increased and the working process of the frame does not become complex.

For achieving the above-mentioned objectives, a first embodiment of a color cathode ray tube apparatus of this invention comprises a funnel, a panel, a phosphor screen disposed inside of the panel, a shadow mask disposed in the vicinity of the phosphor screen, a frame on which the shadow mask is fixed and an electron gun disposed in a neck part of the funnel. The frame has a shadow mask welding face which has a substantially rectangular shape, side walls which are continuously formed along an inner periphery of the shadow mask welding face and are substantially perpendicular to the shadow mask welding face and a flange face which is formed along the side walls and is substantially parallel to the shadow mask welding face. The shadow mask is fixed on the shadow mask welding face of the frame by welding under a condition that a predetermined tension is applied to the shadow mask. The mechanical strength of the longer sides of the frame is higher than that of the shorter sides of the frame. By such a configuration, quantities of the deformation along the longer sides and the shorter sides of the frame can be made equal to the quantities of the deformation of the shadow mask along the longer sides and the shorter sides. Thus, after the welding of the shadow mask on the frame, the tension applied to the shadow mask can be made even. Furthermore, the deformation of the frame is smaller, so that the tension applied to the shadow mask can be maintained in a predetermined value. Still furthermore, in a manufacturing process or normal actuation of the color cathode ray tube apparatus, even when the shadow mask and/or the frame are/is deformed by thermal expansion, an assembly in which the shadow mask is welded on the frame maintains a similar shape to that of the initial state. Thus, no corrugation occurs on the shadow mask face. As a result, the thermal expansion of the shadow mask can be cancelled or absorbed by the tension applied to the shadow mask. Positions of electron beam through holes and phosphor regions on a phosphor screen of the color cathode ray tube apparatus are relatively coincident with each other. The mislanding in a picture image displayed on the screen of the color cathode ray tube apparatus can be reduced.

In the above-mentioned configuration, it is preferable that reinforcing members are provided on respective longer sides of the frame. Alternatively, it is preferable that reinforcing members are provided on respective longer sides and shorter sides of the frame, and at least one of shape, thickness, number and material of the reinforcing members provided on the longer sides is different from that of the reinforcing members provided on the shorter sides. By such a configuration, the frame, in which the mechanical strength of the longer side is higher than that of the shorter side, can easily be obtained by applying the conventional frame.

Furthermore, it is preferable that the reinforcing member is a rectangular plate which is fixed on the flange face of the frame. Alternatively, the reinforcing member is a rectangular plate which is obliquely fixed between the side wall and the flange face of the frame. Alternatively, it is preferable that the reinforcing member is a substantially triangular shaped plate which is fixed between the side wall and the flange face and substantially perpendicular to the shadow mask welding face. By such a configuration, the mechanical strength of the longer side of the frame can be made higher than that of the shorter side easily, without using a special working method.

Still furthermore, it is preferable that a width of at least a part of the flange face on each longer side of the frame is wider than a width of the flange face on each shorter side of the frame. Alternatively, it is preferable that the side wall on each longer side of the frame swells outward on a plane parallel to the shadow mask welding face. Alternatively, it is preferable that at least a part of the flange face on each shorter side of the frame is cut out. Alternatively, it is preferable that a height of at least a part of side wall on each shorter side of the frame is lower than that of the side wall on each longer side. By such a configuration, the frame, in which the mechanical strength of the longer side is higher than that of the shorter side, likewise can easily be obtained. In these cases, the frame can be formed integrally by press working, so that the configurations of the frame are suitable for mass production.

Furthermore, it is preferable that the longer sides and the shorter sides of the frame are respectively formed as independent members, and a thickness of a first member for the longer side is larger than that of a second member for the shorter side. Alternatively, it is preferable that the longer sides and the shorter sides of the frame are respectively formed as independent members, and a material of a first member for the longer side is different from that of a second member for the shorter side. By such a configuration, the frame, in which the mechanical strength of the longer side is higher than that of the shorter side, can be obtained. These configurations of the frame are suitable for a production of small quantity. In the latter case, it is especially preferable that Young's modulus of the material of the first member for the longer side is higher than that of the second member for the shorter side. Thereby, the thickness and the shape of the cross-section of the first member can be made the same as those of the second member. As a result, the assembly of the frame can be made easier without using any special jig.

Furthermore, it is preferable that a thermal expansion coefficient of a material of the frame is smaller than that of a material of the shadow mask. By such a configuration, it is possible to prevent the plastic deformation of the shadow mask due to the difference between the heat capacities of the frame and the shadow mask, when the funnel and the panel of the color cathode ray tube apparatus, which are made of glass, are connected.

On the other hand, a second embodiment of a color cathode ray tube apparatus of this invention comprises a funnel, a panel, a phosphor screen disposed inside of the panel, a shadow mask disposed in the vicinity of the phosphor screen, a frame on which the shadow mask is fixed and an electron gun disposed in a neck part of the funnel. The frame has a shadow mask welding face in which four sides thereof are continuously formed as substantially rectangular shape and side walls which are continuously formed along an inner periphery of the shadow mask welding face, and has alternately formed perpendicular portions and slanted portions, and a flange face which is formed along the side walls and is substantially parallel to the shadow mask welding face. The perpendicular portions are substantially perpendicular to the shadow mask welding face and the slanted portions are formed to be slanted to the inside of the frame. The shadow mask is fixed on the shadow mask welding face of the frame by welding under a condition that a predetermined tension is applied to the shadow mask. By such a configuration, the slanted portions of the side walls of the frame serve as ribs, so that the rigidity of the frame against the tension applied to the shadow mask can be made higher without increasing the weight. Thus, the deformation of the frame by the tension applied to the shadow mask can be prevented. Furthermore, respective sides of the shadow mask welding face are continued and no cuttings are formed at the corners, so that the tension applied to the shadow mask may not be uneven in the vicinity of the corners. No corrugation occurs in the vicinity of the corners.

In the above-mentioned configuration, it is preferable that the ridge lines of the slanted portions of the side walls are substantially parallel to the sides of the shadow mask welding face, and the slanted portion forms an opening having a substantially triangular shape on a plane perpendicular to the shadow mask welding face with the perpendicular portion of the side wall and the flange face. By such a configuration, the frame can be formed by press working. Furthermore, the mechanical strength of the frame can be made entirely even on respective sides. Furthermore, it is preferable that at least one of the number and the dimension of the perpendicular portion and the slanted portion of the side walls on the longer sides is different from that on the shorter sides. By such a configuration, the mechanical strength of respective sides can be controlled responding to the length of the sides or the strength of the tension applied to the shadow mask.

Still furthermore, a third embodiment of a color cathode ray tube apparatus of this invention comprises a funnel, a panel, a phosphor screen disposed inside of the panel, a shadow mask disposed in the vicinity of the phosphor screen, a frame on which the shadow mask is fixed and an electron gun disposed in a neck part of the funnel. The frame has a shadow mask welding face in which four sides thereof are continuously formed as substantially rectangular in shape and side walls which are continuously formed along an inner periphery of the shadow mask welding face, and has alternately formed perpendicular portions and first and second slanted portions, and a flange face which is formed along the side walls and is substantially parallel to the shadow mask welding face. The perpendicular portions are substantially perpendicular to the shadow mask welding face and the first slanted portions are formed to be slanted to the inside of the frame, and the second slanted portions are formed to be slanted to the outside of the frame. The shadow mask is fixed on the shadow mask welding face of the frame by welding under a condition that a predetermined tension is applied to the shadow mask. In the above-mentioned configuration, it is preferable that the ridge lines of the side walls and the shadow mask welding face are straight lines, and the ridge lines of the side walls and the flange face are wave lines. By such a configuration, the frame can be formed by press working. Furthermore, the mechanical strength of the frame can be made entirely even on respective sides.

Furthermore, it is preferable that a cross-sectional shape of the side walls of the frame in the vicinity of the boundary between the shadow mask welding face and the side walls on a plane parallel to the shadow mask welding face is substantially octagonal. Furthermore, it is preferable that the frame is integrally formed by press working. By such a configuration, a gap is formed between the side walls and the shadow mask welding face in the vicinity of each corner of the frame. Thus, the shape of each corner of the shadow mask welding face can be made stable in the press working, and the flatness of the shadow mask welding face can be maintained. Furthermore, it is preferable that the thermal expansion coefficient of the material of the frame is smaller than that of the material of the shadow mask. By such a configuration, it is possible to prevent the plastic deformation of the shadow mask due to the difference between the heat capacities of the frame and the shadow mask, when the funnel and the panel of the color cathode ray tube apparatus, which are made of glass, are connected.

Still furthermore, a fourth embodiment of a color cathode ray tube apparatus of this invention comprises a funnel, a panel, a phosphor screen disposed inside of the panel, a shadow mask disposed in the vicinity of the phosphor screen, a frame on which the shadow mask is fixed and an electron gun disposed in a neck part of the funnel, and wherein the shadow mask is fixed on the frame under a condition that a predetermined tension is applied to the shadow mask. The frame is made of a material having a thermal expansion coefficient smaller than that of a material of the shadow mask. When the thermal expansion coefficient of the material of the frame is $\alpha_F$ (1/°C.), the temperature rise of the shadow mask in the actuation of the color cathode ray tube apparatus is $\Delta t_o$ (°C.), the temperature rise of the shadow mask in the heat treatment during the producing process of the color cathode ray tube apparatus is $\Delta t$ (°C.), the thermal expansion coefficient of the material of the shadow mask is $\alpha_M$ (1/°C.), Young' modulus of the material of the shadow mask at the normal temperature is $E_M$ (kg/mm$^2$), and the tension applied to the shadow mask is T (kg/mm$^2$), the equations of $$\alpha_F \leqq \alpha_M(1-(\Delta t_o/\Delta t)) \text{ and}$$

$$T \geqq \alpha_M \cdot \Delta t_0 \cdot E_m$$

are satisfied. By such a configuration, the quantity of the thermal expansion of the shadow mask becomes larger than that of the frame in the heat treatment of the manufacturing process. The shadow mask temporarily reduces the tension at a high temperature by the expansion. Thus, the plastic deformation may not occur on the shadow mask. When the heat treatment is completed, the shadow mask is contracted, so that the tension applied to the shadow mask recovers. As a result, the tension, by which the thermal expansion of the shadow mask by the irradiation of the electron beams in the normal actuation of the color cathode ray tube apparatus can be cancelled or absorbed, remains after the heat treatment.

DETAILED DESCRIPTION OF THE INVENTION

Figure 1:
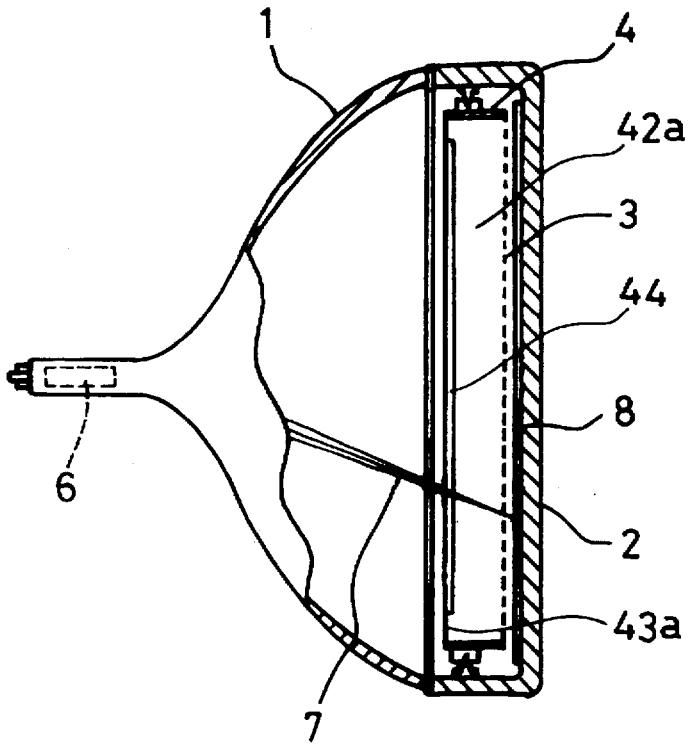
FIG. 1 is a cross-sectional plan view showing a configuration of a first embodiment of a color cathode ray tube apparatus of this invention.

A first embodiment of a color cathode ray tube apparatus of this invention is described referring to FIGS. 1 to 4. As can be seen from FIG. 1, the first embodiment of the color cathode ray tube apparatus of this invention comprises a funnel 1 made of glass, a panel 2 made of glass, a phosphor screen 8 disposed inside of the panel 2, a shadow mask 3 disposed in the vicinity of the phosphor screen 8, a frame 4 for supporting the shadow mask 3, and an electron gun 6 disposed in a neck part of the funnel 1. The shadow mask 3 is fixed on the frame 4 by resistance welding, laser welding working, and the like under a condition that a predetermined tension of about 10 $Kg/mm^2$ is applied to the shadow mask 3. The longer sides of the frame are about 333 mm, and the shorter sides are about 256 mm. The cross-sectional shapes of the respective sides are substantially L-shaped.

Electron beams, which correspond to red, green and blue colors and are radiated from the electron gun 6, pass through predetermined electron beam through holes formed on the shadow mask and reach predetermined phosphor regions of the phosphor screen 8 corresponding to the colors of the electron beams. Each phosphor region, which is irradiated by the electron beam, luminates the color of red, green or blue corresponding to the electron beam. Thus, a color picture image can be displayed on the screen of the panel 2 of the color cathode ray tube apparatus.

Figure 2:
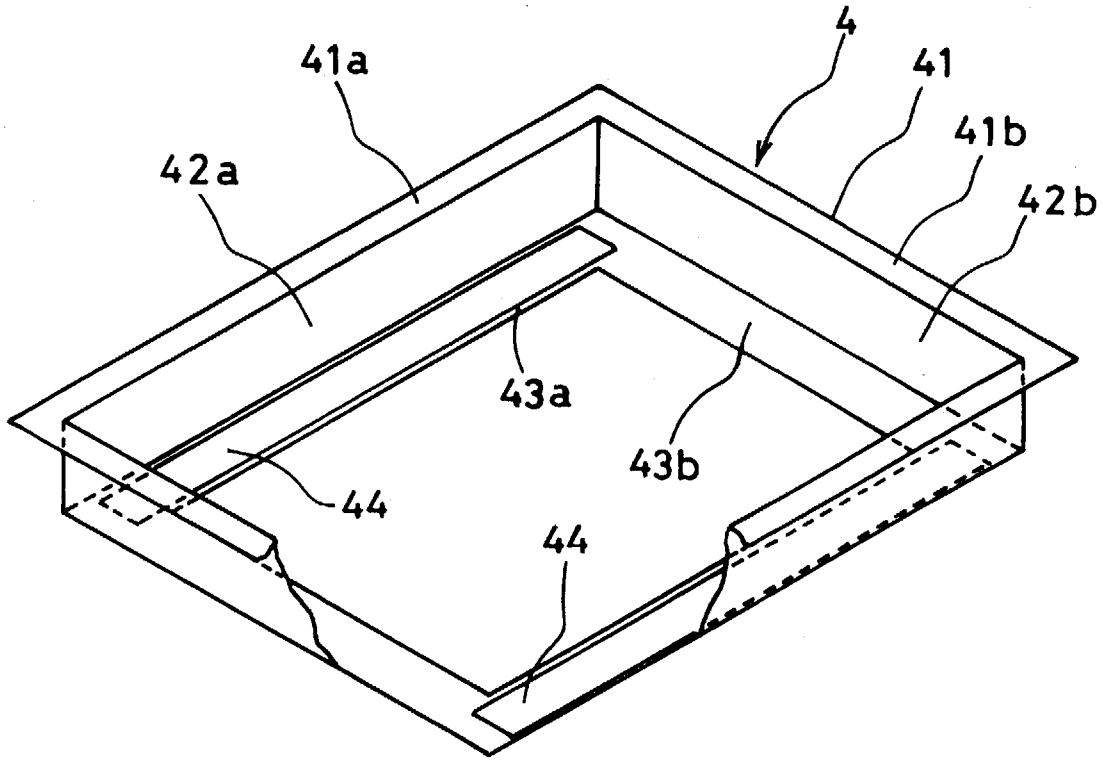
FIG. 2 is a perspective view showing a configuration of a frame in the first embodiment.

As can be seen from FIG. 2, the frame 4 has a substantially rectangular shape viewed on a plane parallel to the shadow mask 3. A shadow mask welding face 41, which is parallel to the shadow mask 3, is formed at an open end of the frame 4. Flange faces 43*a* and 43*b*, which are parallel to the shadow mask welding face 41, are formed at the other open end of the frame 4. Side walls 42*a* and 42*b* are integrally formed along the inner peripheries of longer sides 41*a* and shorter sides 41*b* of the shadow mask welding face 41. Furthermore, the side walls 42*a* and 42*b* and the flange faces 43*a* and 43*b* are respectively formed integrally. Reinforcing plates 44 are respectively fixed on the flange faces 43*a* on the longer sides.

Figure 3:
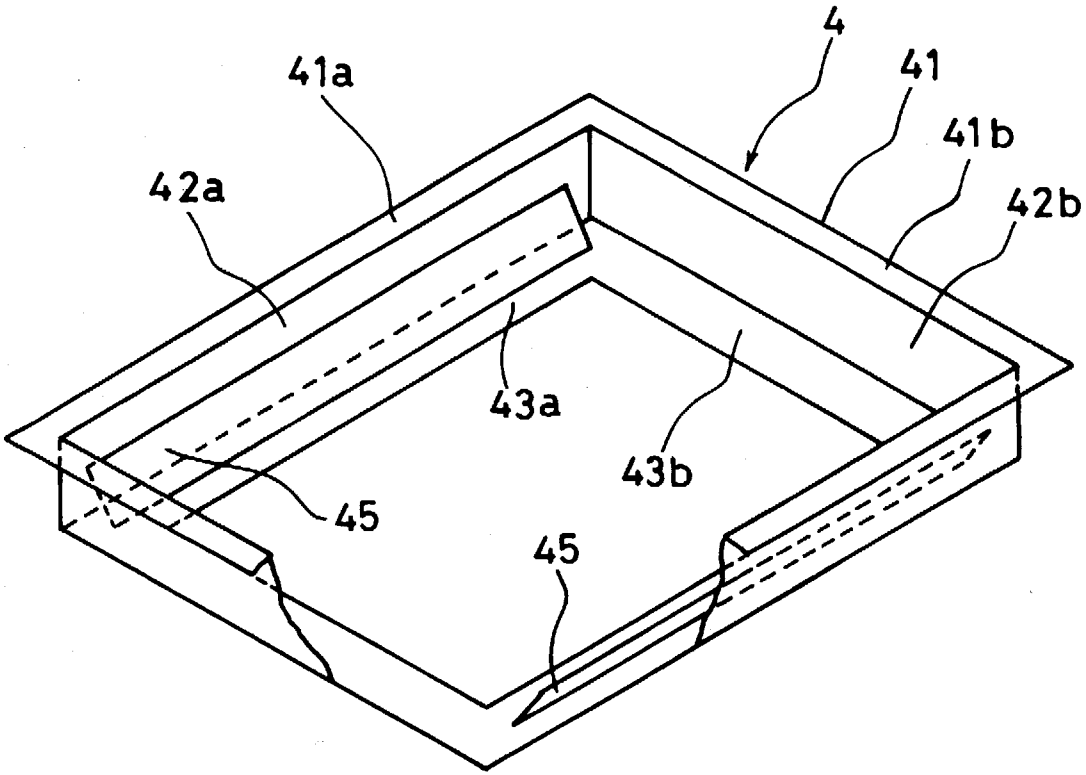
FIG. 3 is a perspective view showing another configuration of the frame in the first embodiment.
Figure 4:
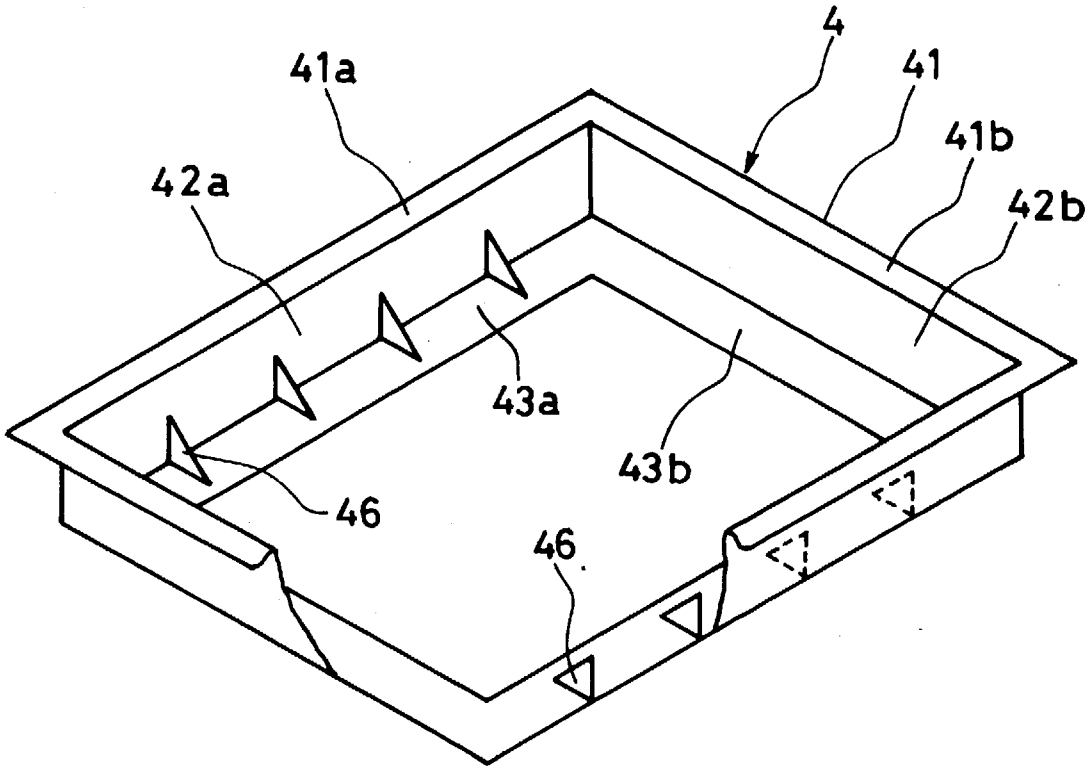
FIG. 4 is a perspective view showing still another configuration of the frame in the first embodiment.

The frame 4 shown in FIG. 2 can be obtained by fixing the reinforcing plates 44 by spot welding and the like on a frame which is conventionally used and is integrally formed by press working. As mentioned above, when the reinforcing plates 44 are provided on the flange faces 43*a* on the longer sides of the frame 4, a frame, in which the mechanical strength of the longer sides is higher than that of the shorter sides, can easily be obtained. Alternatively, as shown in FIG. 3, substantially rectangular plates 45, which are obliquely fixed between the side walls 42*a* and the flange faces 43*a* on the longer sides, can be used as reinforcing plates. Thereby, the mechanical strength of the longer sides can be made higher than that of the shorter sides. Alternatively, as shown in FIG. 4, substantially triangle plates 46, which are fixed between the side walls 42*a* and the flanges 43*a* on the longer sides at a predetermined intervals and oriented to be perpendicular to the shadow mask 3, can be used as reinforcing plates. Thereby, the mechanical strength of the longer sides similarly can be made higher than that of the shorter sides.

For discussion, the length of the longer sides (41*a*, 42*a*, 43*a*) of the frame 4 will be called L1, the length of the shorter sides (41*b*, 42*b*, 43*b*) of the frame 4 L2, Young's modulus of the shadow mask 3 along the longer side E1, Young's modulus of the shadow mask 3 along the shorter sides E2, a tension applied to the shadow mask 3 in a direction parallel to the longer sides T1, a tension applied to the shadow mask 3 in a direction parallel to the shorter sides T2, a rigidity of the longer sides of the frame 4 G1. and a rigidity of the shorter sides of the frame 4 G2. When the material and the shape of the frame 4 satisfy the equation of $$\frac{L2 \cdot E1 \cdot T1}{L1 \cdot E2 \cdot T2} = \frac{G1}{G2}.$$

quantities of the deformation of the longer sides and the shorter sides of the frame 4 can be made the same as those of the shadow mask 3. Thus, even when the shadow mask 3 is welded on the frame 4, the tension applied to the shadow mask 3 can be made even in each direction. As a result, the position of each electron through hole formed on the shadow mask 3 and the position of the phosphor region corresponding to the electron beam through hole can coincide with each other. Mislanding of the picture image on the screen can be prevented substantially perfectly.

As a material of the shadow mask 3, iron was used. As a material of the frame 4, an alloy selected from 13% Cr—Fe, 18% Cr—Fe, 50% Ni—Fe and 42% Ni—Fe, which have a thermal expansion coefficient smaller than that of the soft steel, was used.

When the funnel 1 and the panel 2 were connected, the frame 4 and the shadow mask 3 were exposed to a high temperature at the circumference for a long time. However, the thermal expansion of the frame 4 was smaller than that of the shadow mask 3. Thus, the material of the shadow mask did not surpass the elastic limit, and no plastic deformation has occurred in the shadow mask 3.

By the above-mentioned configuration, the mechanical strength of the longer sides of the frame 4 could be made higher than that of the shorter sides of the frame 4. Thus, even when the stress on the longer sides due to the tension of the shadow mask 3 was larger than that of the shorter sides, the quantity of the deformation of the longer sides of the frame 4 could be made smaller. As a result, quantities of the deformation of the longer sides and the shorter sides of the frame 4 could be made the same as those of the shadow mask 3. Thus, after the welding of the shadow mask 3 on the frame 4, the tension applied to the shadow mask 3 could be made even in each direction. Furthermore, since the deformation of the frame 4 was smaller, the predetermined tension of the shadow mask 3 could be obtained. Thus, the thermal expansion of the shadow mask 3 could be cancelled or absorbed by the tension applied to the shadow mask 3. The relative position of each electron beam through hole on the shadow mask 3 could coincide with the position of the phosphor region corresponding to the electron beam through hole. The mislanding of the picture image displayed on the screen was not observed.

In the first embodiment, the reinforcing plates 44, 45 or 46 are provided only on the longer sides of the frame 4.

However, it is possible to provide the reinforcing member on not only the longer sides but also the shorter sides of the frame 4. In such a case, at least one of the shape, thickness, number and material of the reinforcing member on the longer sides is different from that of the reinforcing member on the shorter sides. Thereby, the mechanical strength of the longer sides of the frame 4 can be higher than that of the shorter sides. Furthermore, it is possible that the reinforcing plates 44, 45 or 46 are used in combination with other kinds of the reinforcing plates in the remainder. The same effects can be obtained in the latter case.

A second embodiment of a color cathode ray tube apparatus of this invention is described referring to FIGS. 5 to 8. The configuration of the second embodiment of the color cathode ray tube apparatus of this invention is substantially the same as that of the first embodiment shown in FIG. 1. However, only the shape of the frame 4 in the second embodiment is different from that in the first embodiment. Thus, the explanation of the duplicated configuration of the color cathode ray tube apparatus is omitted.

Figure 5:
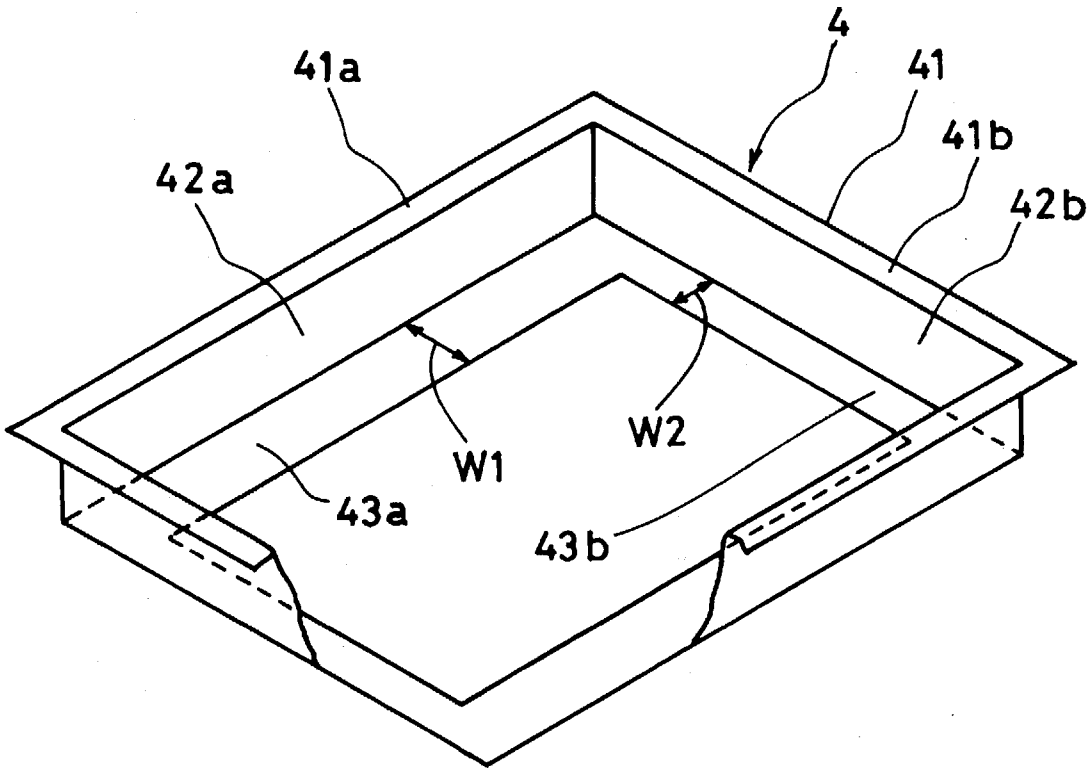
FIG. 5 is a perspective view showing a configuration of a frame in a second embodiment of a color cathode ray tube apparatus of this invention.

As can be seen from FIG. 5, the frame 4 has a substantially rectangular shape on a plane parallel to the shadow mask 3 (not shown in FIG. 5). A shadow mask welding face 41, which is parallel to the shadow mask 3, is formed at an open end of the frame 4. Flange faces 43*a* and 43*b*, which are parallel to the shadow mask welding face 41, are formed at the other open end of the frame 4. Side walls 42*a* and 42*b* are integrally formed along inner peripheries of longer sides 41*a* and shorter sides 41*b* of the shadow mask welding face 41. Furthermore, the side walls 42*a* and 42*b* and the flange faces 43*a* and 43*b* are respectively formed integrally. Herein, a width W1 of the flange face 43*a* on the longer sides is wider than a width W2 of the flange face 43*b* on the shorter sides.

Figure 6:
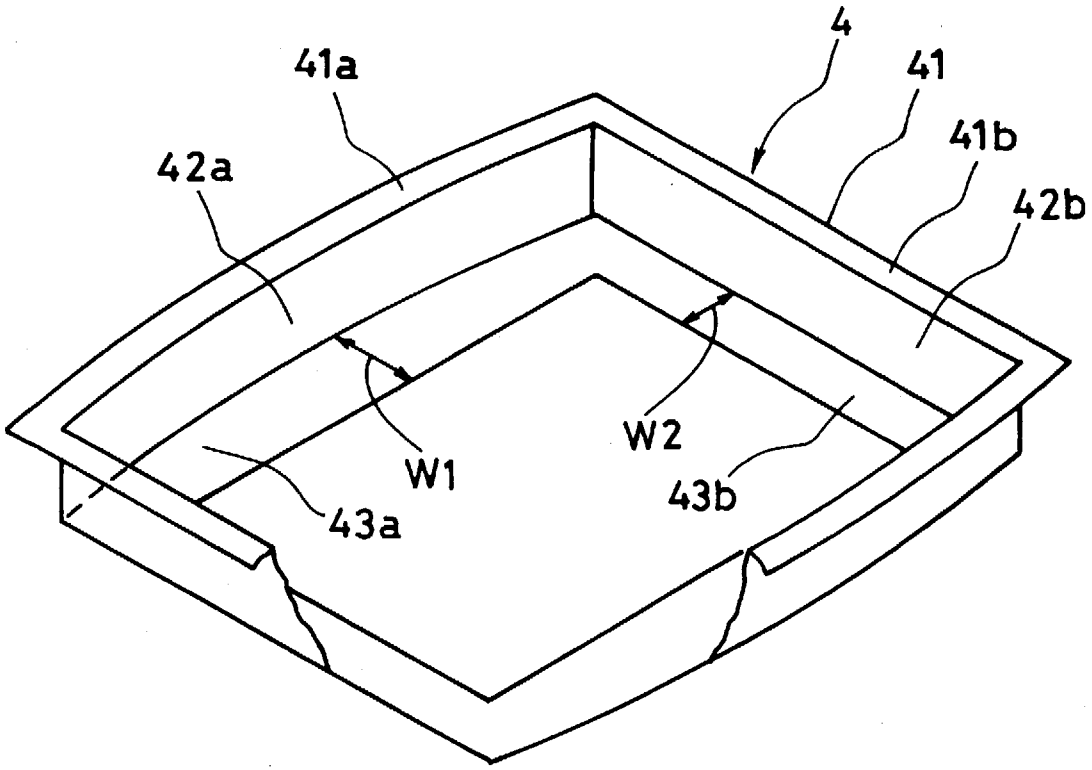
FIG. 6 is a perspective view showing another configuration of the frame in the second embodiment.
Figure 7:
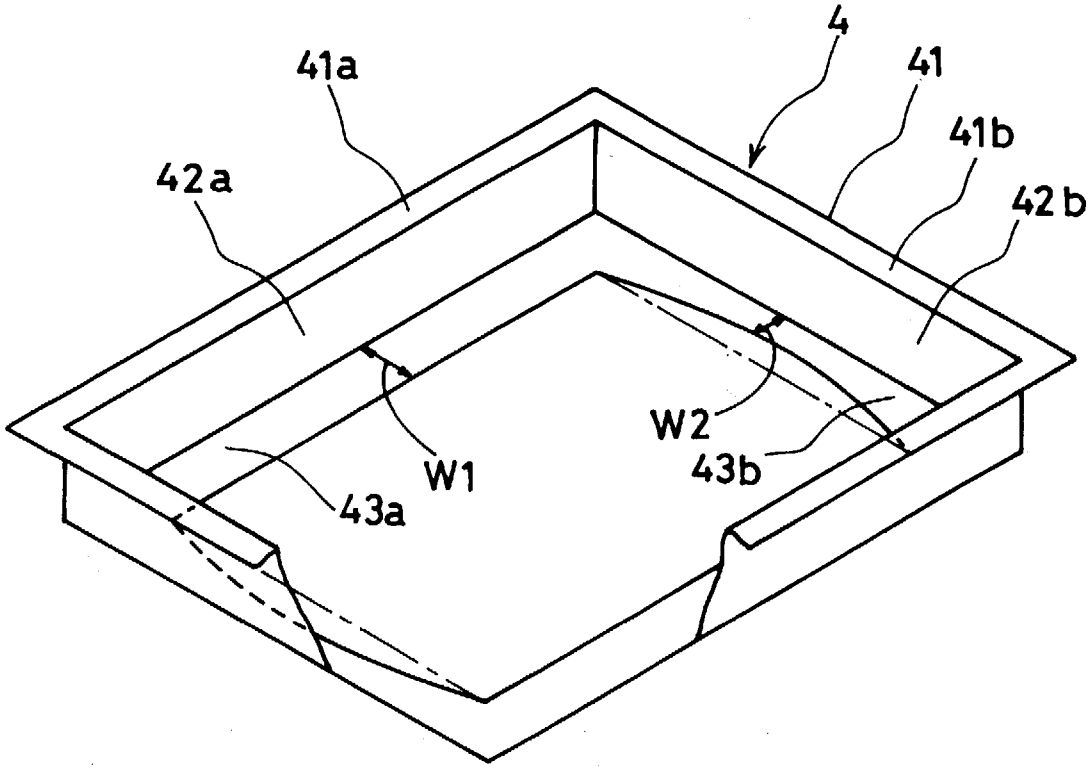
FIG. 7 is a perspective view showing still another configuration of the frame in the second embodiment.
Figure 8:
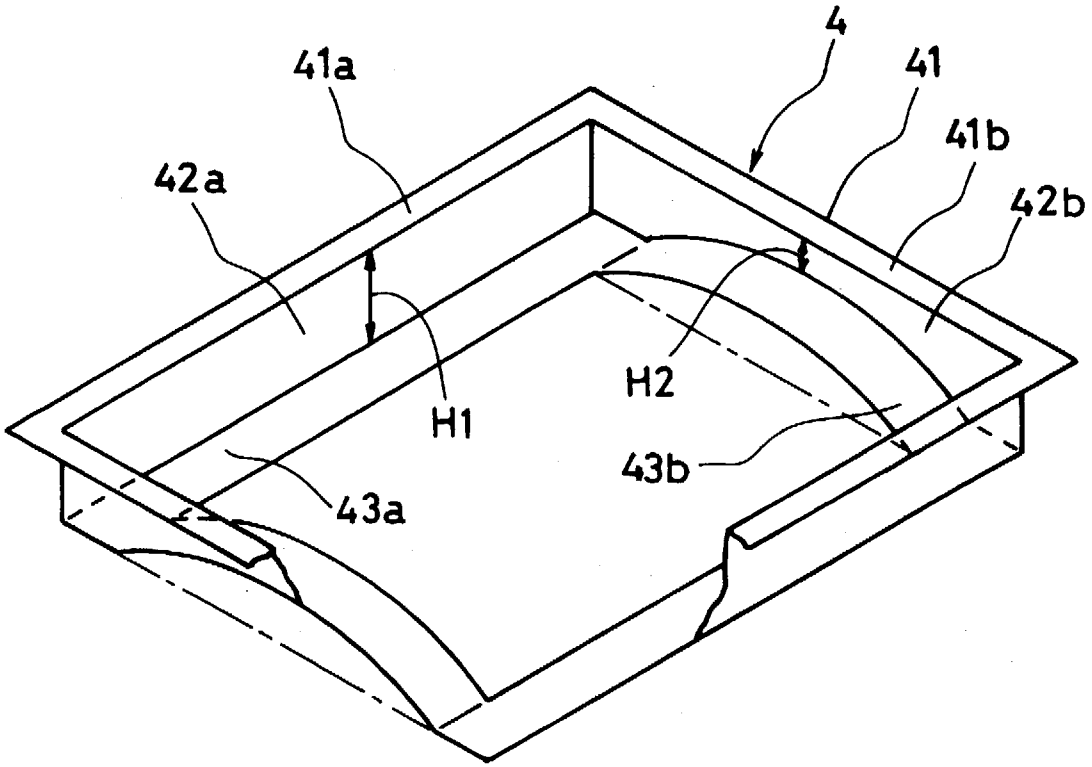
FIG. 8 is a perspective view showing still another configuration of the frame in the second embodiment.

Alternatively, as shown in FIG. 6, it is possible that the side walls 42*a* on the longer sides are protruded outwardly. By such a configuration, the width W1 of the flange face 43*a* on the longer sides can be partially wider than the width w2 of the flange face 43*b* on the shorter sides. Alternatively, as shown in FIG. 7, it is possible to cut a part of the flange face 43*b*. By such a configuration, the width W1 of the flange face 43*a* on the longer sides can be relatively wider than the width w2 of the flange face 43*b* on the shorter sides. Namely, when the width W1 of at least a part of the flange face 43*a* on the longer sides of the frame is made wider than the width W2 of the flange face 43*b* on the shorter sides, a frame in which the mechanical strength of the longer sides is higher than that of the shorter sides can be obtained. Alternatively, as shown in FIG. 8, it is possible that the height H2 of at least a part of the side walls 42*b* on the shorter sides of the frame 4 is smaller than the height H1 of the side walls 41*a* on the longer sides. Thereby, a frame in which the mechanical strength of the longer sides is higher than that of the shorter sides can be obtained. In these cases, the frame 4 can be formed integrally by press working, so that the configuration of the frame 4 is suitable for mass production. Furthermore, each feature of the second embodiment shown in one of FIGS. 5 to 8 can be applied in combination with other features in the remainder. Thereby, a frame in which the mechanical strength of the longer side is higher than that of the shorter sides can be obtained. Still furthermore, it is possible that each feature of the second embodiment can be combined with at least one feature of the first embodiment shown in FIGS. 2 to 4.

Figure 9:
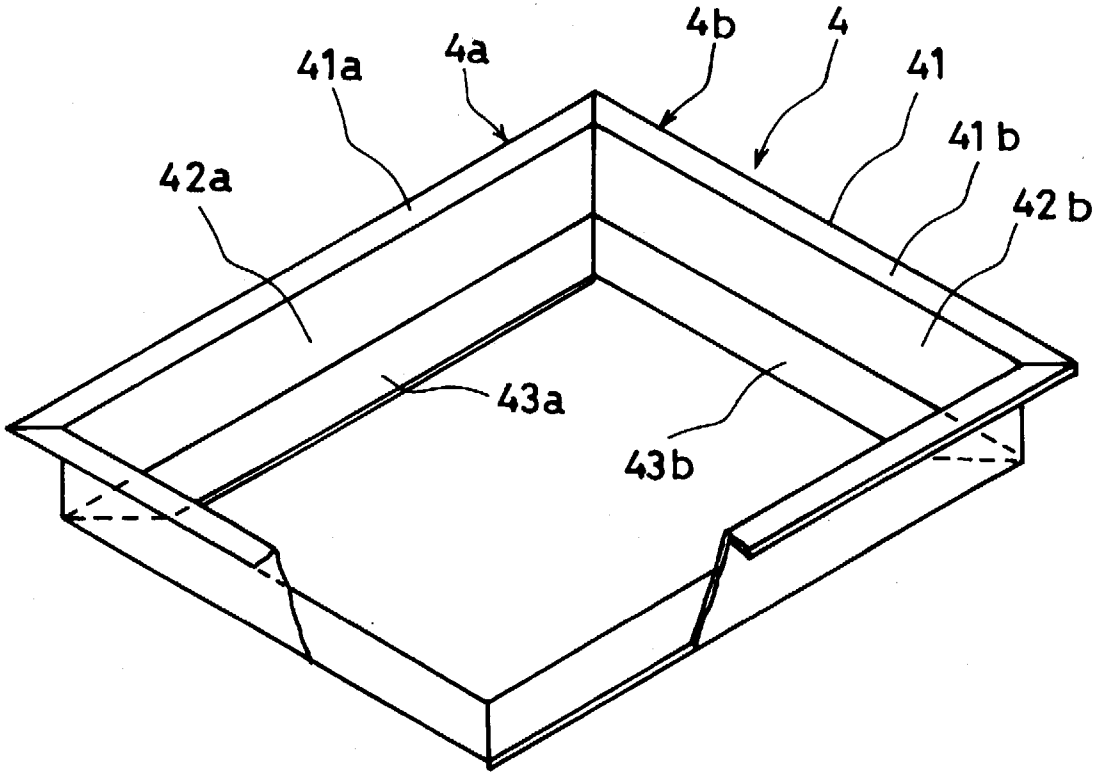
FIG. 9 is a perspective view showing a configuration of a frame in a third embodiment of a color cathode ray tube apparatus of this invention.
Figure 10:
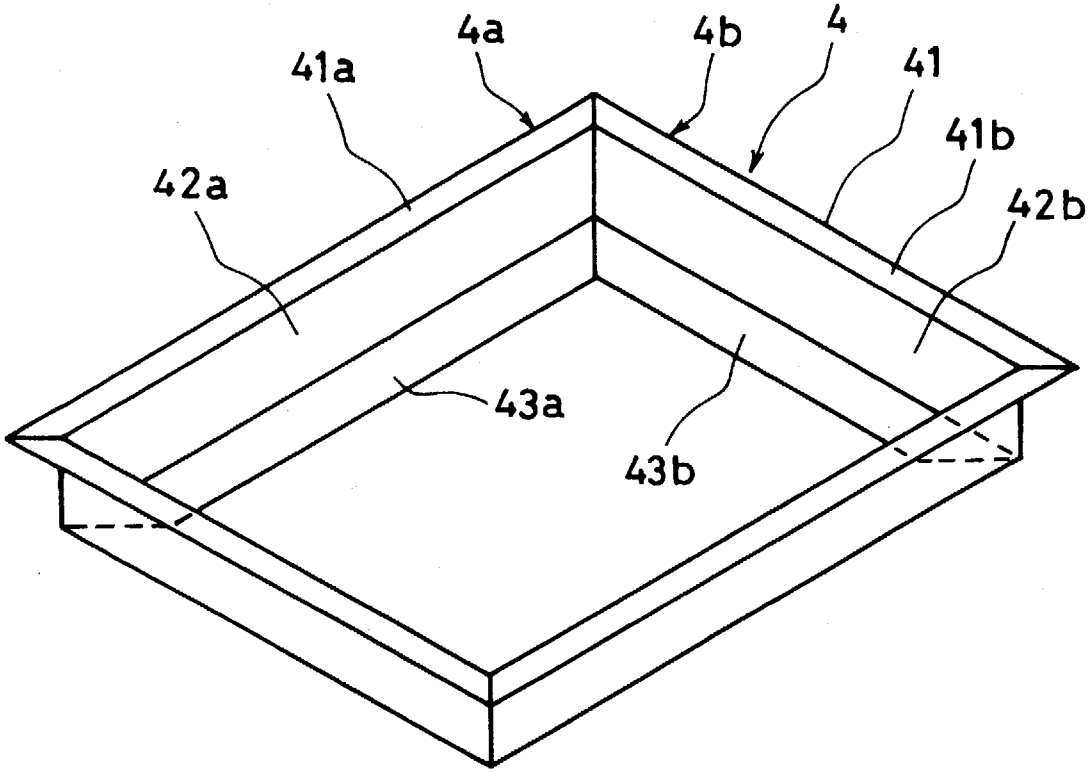
FIG. 10 is a perspective view showing another configuration of the frame in the third embodiment.

Next, a third embodiment of a color cathode ray tube apparatus of this invention is described referring to FIGS. 9 and 10. The configuration of the third embodiment of the color cathode ray tube apparatus of this invention is substantially the same as that of the first embodiment shown in FIG. 1. However, only the shape of the frame 4 in the third embodiment is different from that in the first embodiment. Thus, the explanation of the duplicated configuration of the color cathode ray tube apparatus is omitted.

As can be seen from FIG. 9, the longer sides and the shorter sides of the frame 4 are respectively formed as independent members 4*a* and 4*b*. The thickness of the longer side member 4*a* is larger than that of the shorter side member 4*b*. Since the material of the longer side member 4*a* is essentially the same as that of the shorter side member 4*b*, the frame 4 can be assembled by welding. By such a configuration, a frame in which the mechanical strength of the longer side is higher than that of the shorter sides can be obtained. Alternatively, it is possible that the material of the longer side member 4*a* is different from that of the shorter side member 4*b*. In this case, a material having Young's modulus larger than that of the material of the shorter side member 4*a* can be used as the material of the longer side member 4*a*. Thereby, the thickness and the cross-sectional shape of the longer side member 4*a* can be made the same as those of the shorter side member 4*b*. In the former case shown in FIG. 9, a special jig for adjusting the difference between the thickness of the longer side member 4*a* and the thickness of the shorter side member 4*b* is necessary. However, in the latter case shown in FIG. 10, since the thickness of the longer side member 4*a* can be made the same as that of the shorter side member 4*b*, the special jig for adjusting the difference between the thicknesses is not necessary. Thereby, the difficulty of the welding due to the difference of the materials of the longer side member 4*a* and the shorter side member 4*b* in the latter case can be reduced. As the combination of the materials of the longer side member 4*a* and the shorter side member 4*b*, an alloy including aluminum and stainless steel or normal steel, and stainless steels having different components can be used. The third embodiment is suitable for a production of small quantity.

Figure 11:
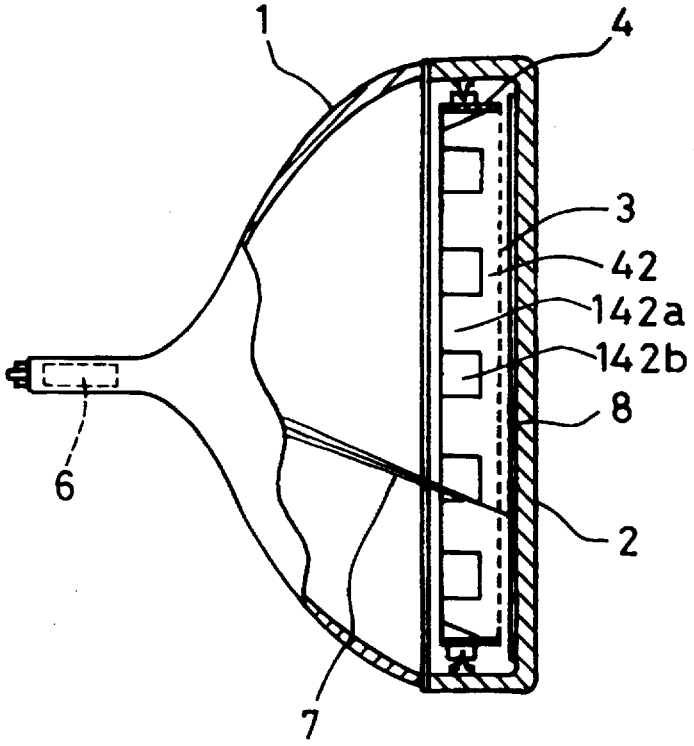
FIG. 11 is a cross-sectional plan view showing a configuration of a fourth embodiment of a color cathode ray tube apparatus of this invention.
Figure 12:
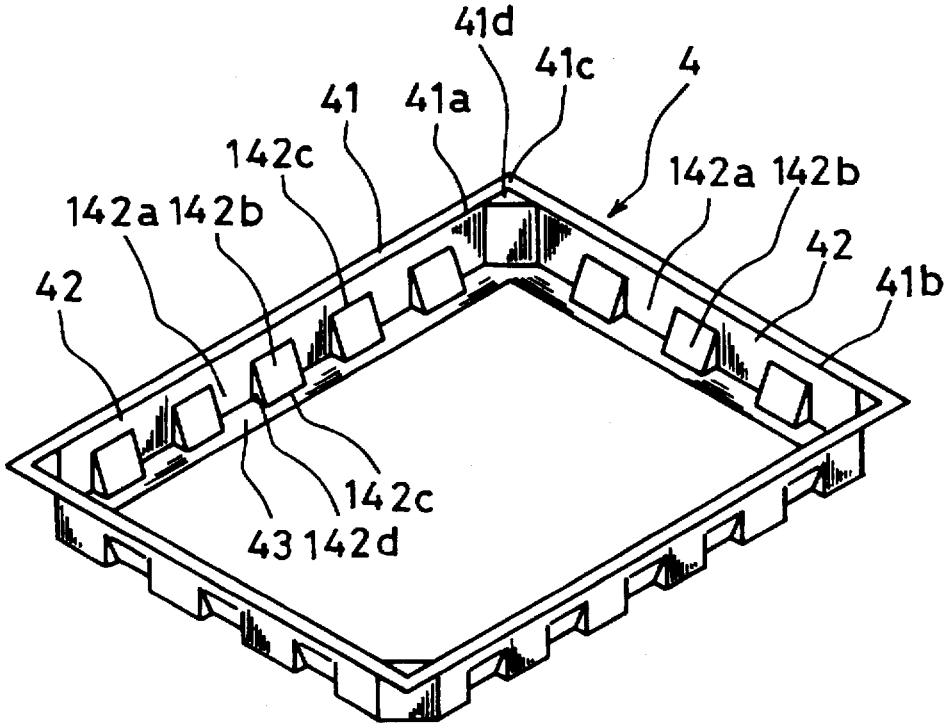
FIG. 12 is a perspective view showing a configuration of a frame in the fourth embodiment.

Next, a fourth embodiment of a color cathode ray tube apparatus of this invention is described referring to FIGS. 11 and 12. As can be seen from FIG. 11, the configuration of the fourth embodiment of the color cathode ray tube apparatus is substantially the same as that of the first embodiment shown in FIG. 1 except the shape of the frame 4. Thus, the detailed explanation of the configuration of the fourth embodiment of the color cathode ray tube apparatus is omitted.

As can be seen from FIG. 12, the frame 4 has a substantially rectangular in cross-section viewed on a plane parallel to the shadow mask 3 (not shown in FIG. 12). A shadow mask welding face 41, which is parallel to the shadow mask 3 and on which the shadow mask 3 is to be welded, is formed at an open end of the frame 4. A flange face 43, which is parallel to the shadow mask 3, is formed at the other open end of the frame 4. The shadow mask welding face 41 is a substantially rectangular shape, in which respective longer sides 41*a* and shorter sides 41*b* are integrally formed. No cutting is formed at each corner. Side walls 42 are integrally formed along inner peripheries of the sides 41*a* and 41*b* of the shadow mask welding face 41. Perpendicular portions 142*a* which are perpendicular to the shadow mask welding face 41 and slanted portions 142*b* which are slanted inside of the frame 4 are alternately formed on the side walls 42. Furthermore, the side walls 42 and the flange face 43 are integrally formed.

Namely, the frame shown in FIG. 12 is formed integrally by press working. For making the press working easy, the ridge lines at the top of the slanted portions 142b on the side walls 42 are substantially parallel to the sides 41a or 41b of the shadow mask welding face 41. On a plane perpendicular to the shadow mask 3, a substantially triangular opening 142d is formed by the perpendicular portion 142a and the slanted portion 142b of the side walls 42 and the flange face 43. Furthermore, the cross-sectional shape of the side walls 42 on a plane parallel to and in the vicinity of the shadow mask welding face 41 is substantially octagonal. By such a configuration, a gap 41d can be formed between each corner 41c of the shadow mask welding face 41 and the side walls 42. Thus, the shape of each corner 41c of the shadow mask welding face 41 can be stable in the press working, and the flatness of the shadow mask welding face 41 can be maintained.

Responding to the length of the longer sides 41a and the shorter sides 41b and the tension applied to the shadow mask 3, at least one of dimension and number of the perpendicular portions 142a and the slanted portions 142b is varied. In this embodiment, the width of the perpendicular portions 142a and the number of the slanted portions 142b are varied.

By the above-mentioned configuration, the slanted portions 142b which are formed on the side walls 42 and slanted to the inside of the frame 4 serve as ribs. Thus, the rigidity of the frame 4 against the tension applied to the shadow mask 3 can be made higher, without increasing the weight of the frame 4. The deformation of the frame 4 due to the tension applied to the shadow mask 3 can be prevented. Furthermore, the longer side 41a and the shorter side 41b are continuously formed at each corner of the shadow mask welding face 41, and no cutting is formed at the corner of the shadow mask welding face 41. The tension applied to the shadow mask 3 may not be uneven in the vicinity of the corners of the shadow mask welding face 41, so that no corrugation occurs in the vicinity of the corners.

Figure 13:
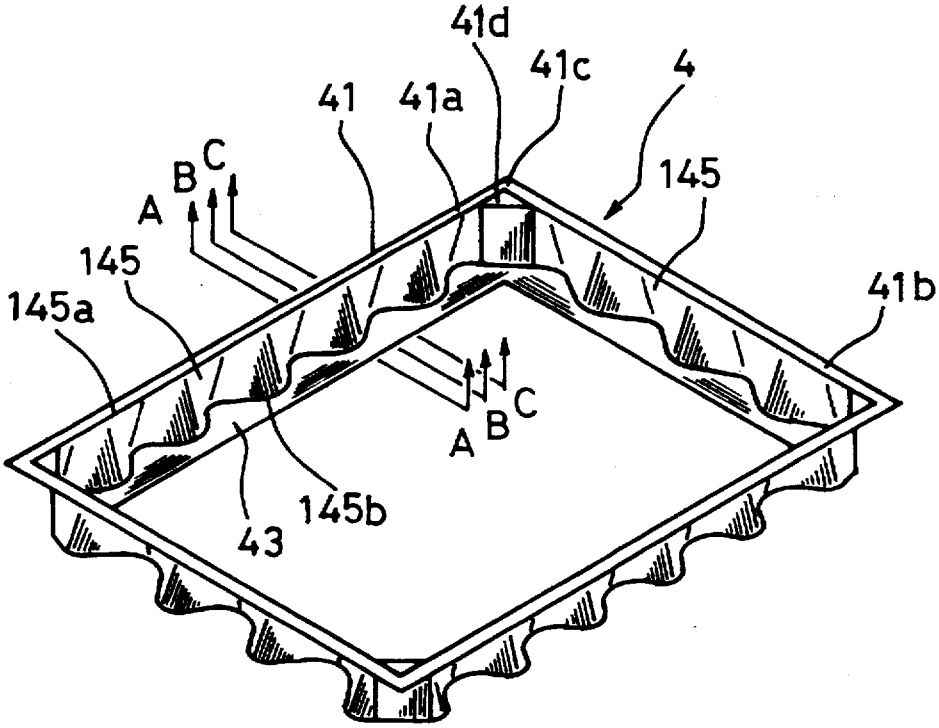
FIG. 13 is a perspective view showing a configuration of a frame in a fifth embodiment of a color cathode ray tube apparatus of this invention.
Figure 14A:
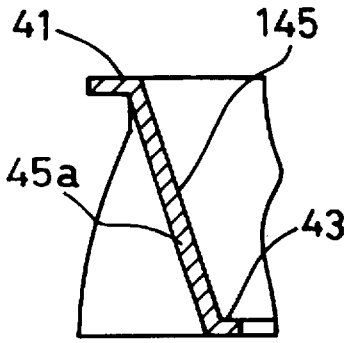
FIGS. 14(*a*), 14(*b*) and 14(*c*) are respectively cross-sectional side views showing configurations of the frame along A—A, B—B and C—C lines.
Figure 14B:
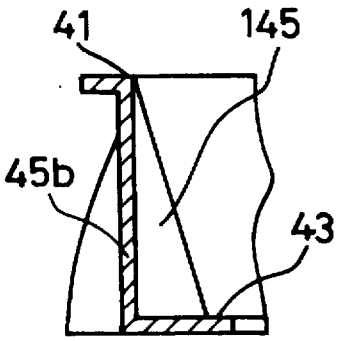
Figure 14C:
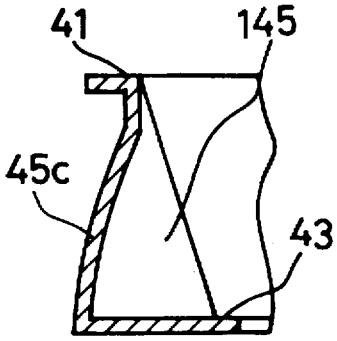

Next, a fifth embodiment of a color cathode ray tube apparatus of this invention is described referring to FIGS. 13, 14(*a*), 14(*b*) and 14(*c*). The configuration of the fifth embodiment of the color cathode ray tube apparatus is substantially the same as the configuration of the first or fourth embodiments shown in FIG. 1 or 11, except for the shape of the frame 4. Thus, the duplicating configuration of the fifth embodiment of the color cathode ray tube apparatus is omitted.

As can be seen from FIG. 13, the frame 4 in the fifth embodiment is substantially rectangular in cross-section viewed on a plane parallel to the shadow mask 3 (not shown in FIG. 13). A shadow mask welding face 41, which is parallel to the shadow mask 3 and on which the shadow mask 3 is to be welded, is formed at an open end of the frame 4. A flange face 43, which is parallel to the shadow mask 3, is formed at the other open end of the frame 4. The shadow mask welding face 41 is of substantially rectangular shape, in which respective longer sides 41a and shorter sides 41b are integrally formed. No cutting is formed at each corner. Side walls 145 are integrally formed along inner peripheries of the sides 41a and 41b of the shadow mask welding face 41.

The side walls 145 are formed by alternation of a first slanted portion 45a shown in FIG. 14(*a*), a slanted portion 45b shown in FIG. 14(*b*) and a second slanted portion 45c shown in FIG. 14(*c*). The first slanted portion 45a is slanted to the inside of the frame 4 along line A—A in FIG. 13. The perpendicular portion 45b is perpendicular to the shadow mask welding face 41 along line B—B in FIG. 13. The second slanted portion 45c is slanted to the outside of the frame 4 along line C—C in FIG. 13. Furthermore, the side walls 42 and the flange face 43 are integrally formed. The ridge lines between the shadow mask welding face 41 and the side walls 145 are respectively straight lines. However, the ridge lines between the flange face 43 and the side walls 145 are wave forms.

Similar to the above-mentioned fourth embodiment, the cross-sectional shape of the side walls 145 on a plane parallel to and in the vicinity of the shadow mask welding face 41 is substantially octagonal. By such a configuration, a gap 41d can be formed between each corner 41c of the shadow mask welding face 41 and the side walls 145. Thus, the shape of each corner 41c of the shadow mask welding face 41 can be stable in the press working, and the flatness of the shadow mask welding face 41 can be maintained.

By the above-mentioned configuration, the first and the second slanted portions 45a and 45c, which are formed on the side walls 145 of the frame 4, serve as ribs. Thus, the rigidity of the frame 4 against the tension applied to the shadow mask 3 can be made higher, without increasing the weight of the frame 4. The deformation of the frame 4 due to the tension applied to the shadow mask 3 can be prevented. Furthermore, the longer side 41a and the shorter side 41b are continuously formed at each corner of the shadow mask welding face 41, and no cutting is formed at the corner of the shadow mask welding face 41. The tension applied to the shadow mask 3 may not be uneven in the vicinity of the corners of the shadow mask welding face 41, so that no corrugation occurs in the vicinity of the corners.

In the above-mentioned forth and fifth embodiment, as a material of the shadow mask 3, iron was used. As a material of the frame 4, an alloy selected from 13% Cr—Fe, 18% Cr—Fe, 50% Ni—Fe and 42% Ni—Fe, which have a thermal expansion coefficient smaller than that of the soft steel, was used. When the funnel 1 and the panel 2 were connected, the frame 4 and the shadow mask 3 were exposed to a high temperature at the circumference for a long time. However, the thermal expansion of the frame 4 was smaller than that of the shadow mask 3. Thus, the material of the shadow mask did not surpass the elastic limit, and no plastic deformation occurred in the shadow mask 3.

Next, a sixth embodiment of a color cathode ray tube apparatus of this invention is described referring to FIGS. 15 to 18. The configuration of the sixth embodiment of the color cathode ray tube apparatus is substantially the same as the configuration of the first or fourth embodiments shown in FIG. 1 or 11, except for the shape of the frame 4. Thus, the duplicating configuration of the fifth embodiment of the color cathode ray tube apparatus is omitted.

Figure 15:
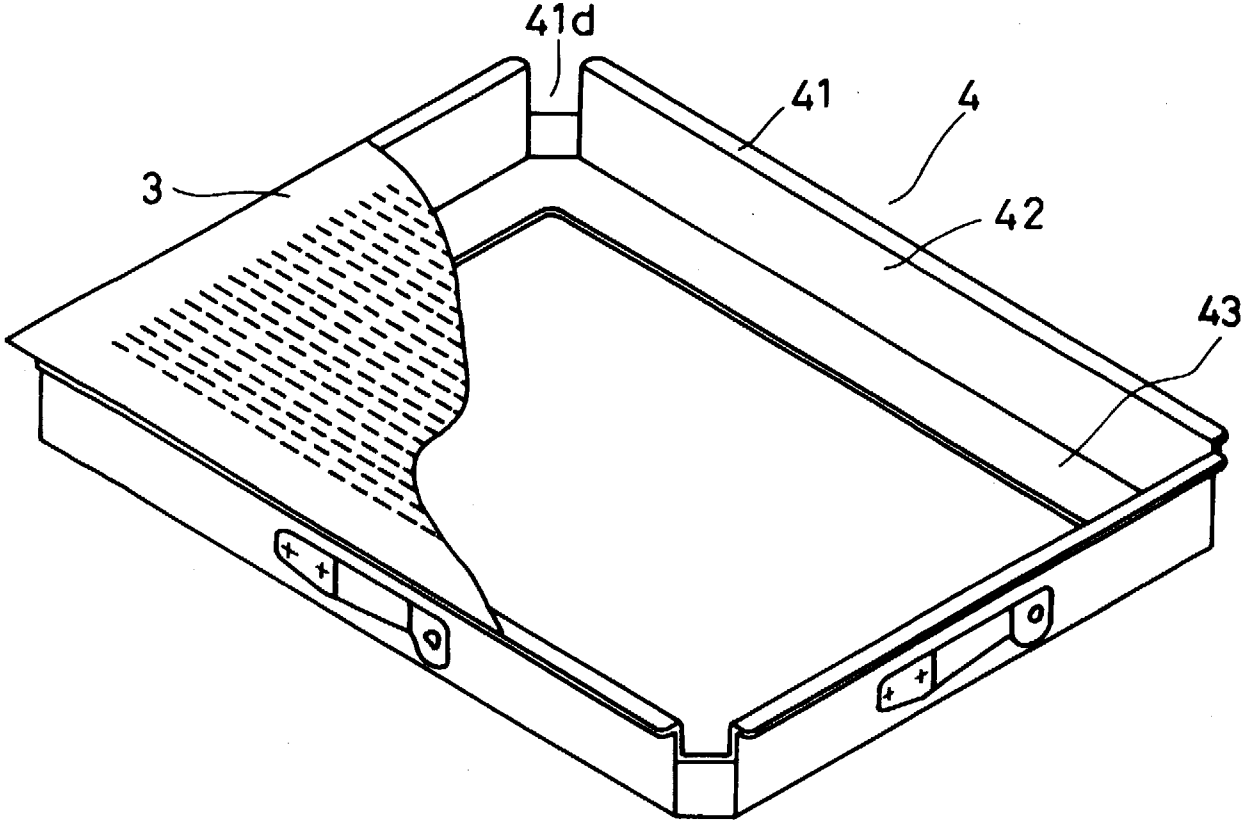
FIG. 15 is a perspective view showing a configuration of a frame in a sixth embodiment of a color cathode ray tube apparatus of this invention.
Figure 16:
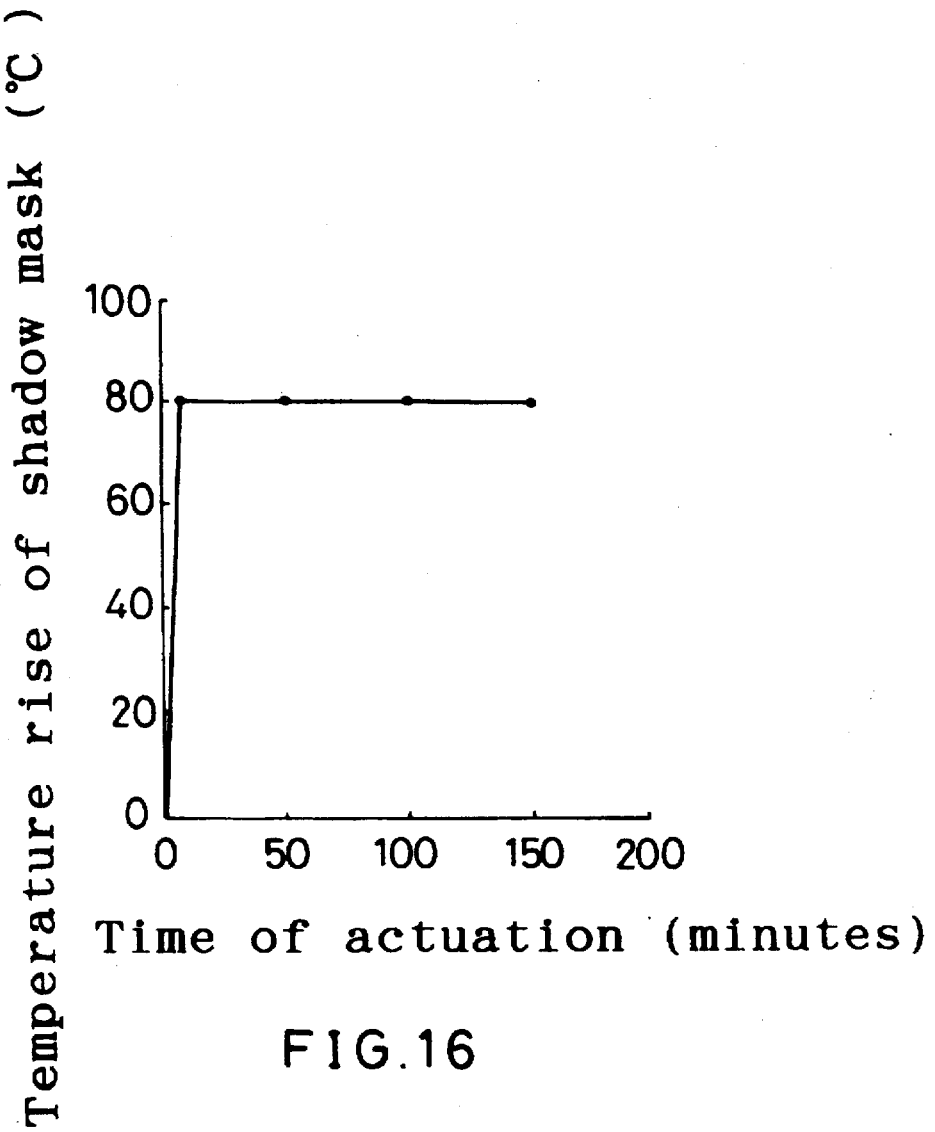
FIG. 16 is a drawing showing the temperature rise of a shadow mask during normal operation of the color cathode ray tube apparatus.

As can be seen from FIG. 15, a shadow mask 3, which is made of an iron and has electron beam through holes arranged in a pitch of about 0.26 mm, is fixed on a frame 4 with a tension for cancelling or absorbing thermal expansion of the shadow mask 3 during normal operation of the color cathode ray tube apparatus. The frame 4 is made of an alloy containing 50% Ni and Fe. A slit 41d is formed at each corner 41c of a shadow mask welding face 41 for providing an elasticity to the frame 4. Under a condition that side walls 42 of the frame 4 are warped to the inside of the frame 4, the shadow mask 3 is welded on the shadow mask welding face 41. Thereby, a predetermined tension can be applied to the shadow mask 3.

When the shadow mask 3 is made of iron, the thermal expansion coefficient $\alpha_M$ is $12\times10^{-6}$ (1/°C.) and Young's modulus $E_M$ is 9800 kg/mm$^2$. When the room temperature is 20 degrees Celsius, the temperature rise of the shadow mask during the normal operation of the color cathode ray tube apparatus will be about 80 degrees Celsius. The tension T for cancelling or absorbing the thermal expansion of the shadow mask during the normal operation is obtained by the equation of $$T \cong \alpha_M \cdot \Delta t_o \cdot E_M.$$

Actually, T is over 9.4 kg/mm$^2$.

Figure 17:
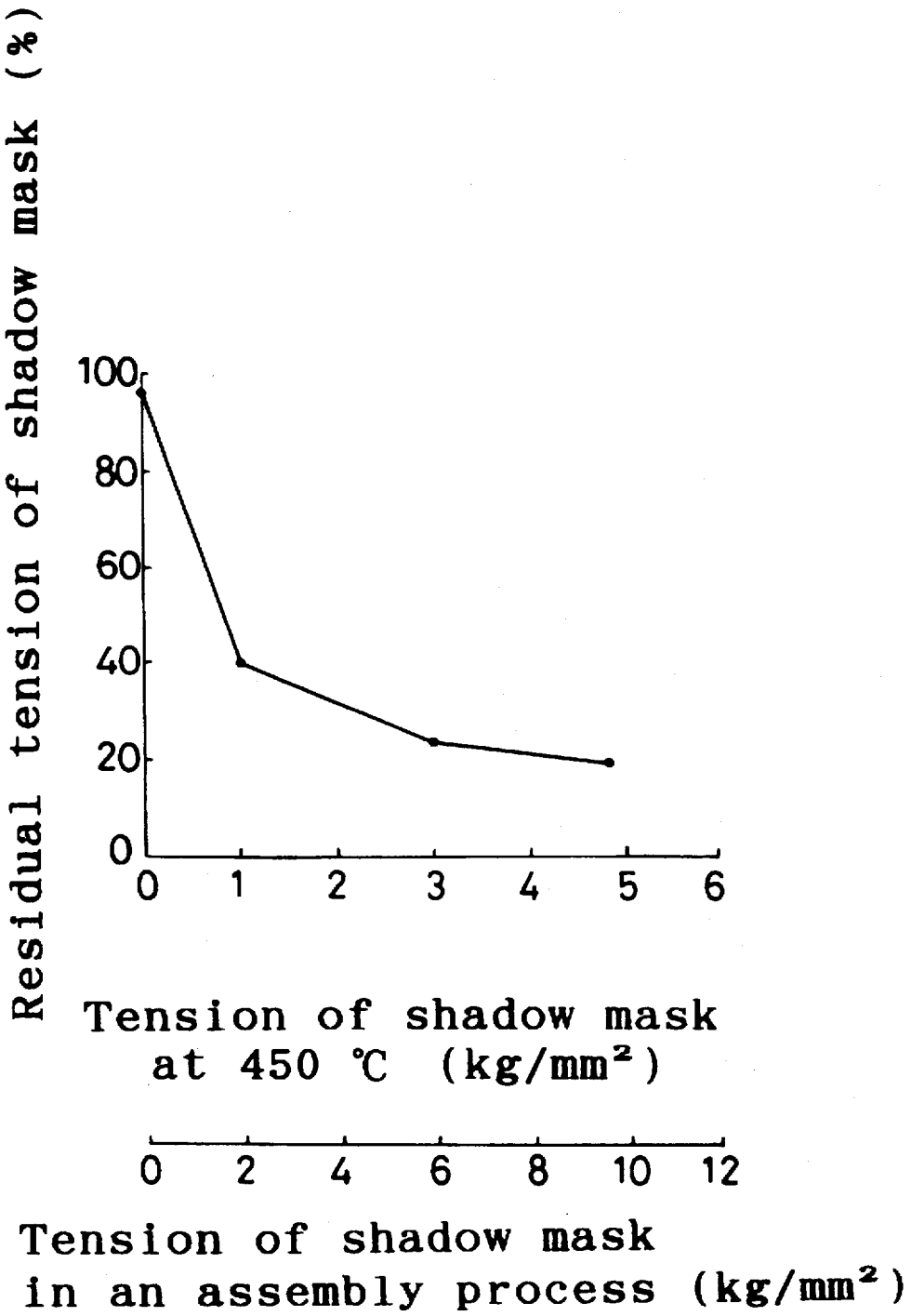
FIG. 17 is a drawing showing a characteristic curve of the reduction of a tension applied to the shadow mask.
Figure 18:
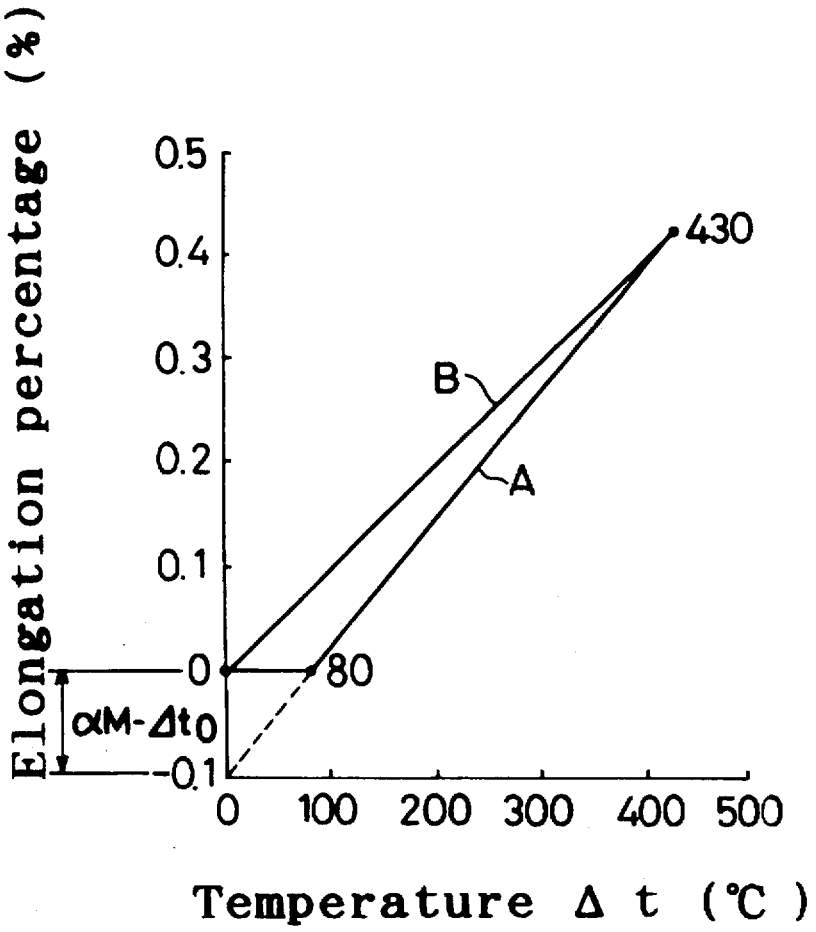
FIG. 18 is a drawing showing characteristic curves of the thermal expansion of the shadow mask and the frame.

A relation between the tension applied to the shadow mask 3 and the reduction of the tension after a heat treatment is shown in FIG. 17. When a conventional color cathode ray tube apparatus was produced with a shadow mask assembly, in which the shadow mask 3 made of iron was fixed on the frame 4 made of the same iron with a tension of 9.4 kg/mm$^2$, the tension applied to the shadow mask 3 was reduced by about 70 to 80% after the heat treatment in a temperature of about 450 degree Celsius. The reason the tension applied to the shadow mask 3 was reduced was the plastic deformation of the shadow mask.

As can be seen from FIG. 17, it is preferable that the tension applied to the shadow mask 3 is zero for preventing the reduction of the tension applied to the shadow mask 3 due to the heat treatment. However, it is necessary that the tension applied to the shadow mask 3 in the assembly of the shadow mask assembly is 9.4 kg/mm$^2$. Thus, it is impossible to make the tension applied to the shadow mask 3 zero.

Therefore, a shadow mask assembly, in which the tension applied to the shadow mask 3 is zero at the temperature of 450 degrees Celsius in the heat treatment and the tension cancelling the thermal expansion can be applied to the shadow mask 3 during the normal operation of the color cathode ray tube apparatus, is necessary. For obtaining such a shadow mask assembly, a thermal expansion coefficient $\alpha_F$ of the frame 4, in which the characteristic curve A of the thermal expansion of the shadow mask 3 and the characteristic curve B of the frame 4 cross at 450 degrees Celsius, is obtained from FIG. 18. A relation between the thermal expansion coefficient $\alpha_F$ of the frame 4, by which the tension applied to the shadow mask 3 becomes zero at 450 degrees Celsius, and the thermal expansion coefficient $\alpha_M$ of the shadow mask 3 is shown by the equation of $$\alpha_F \leqq \alpha_M(1-(\Delta t_o/\Delta t)).$$

Herein, the temperature rise of the shadow mask 3 during the normal operation of the color cathode ray tube apparatus is $\Delta t_o$ (°C.) and the temperature rise of the shadow mask 3 in the heat treatment during the producing process of the color cathode ray tube apparatus is fit $\Delta t$ (°C.). The thermal expansion coefficient can be decided by the above-mentioned equation.

When the shadow mask 3 is made of iron, the thermal expansion coefficient of the frame $\alpha_F$ is obtained by $$\alpha_F \leqq 12\times10^{-6}\times(1-(80/430)).$$

Namely, the value of the thermal expansion coefficient of the frame 4 is to be smaller than $9.7\times10^{-6}$ (1/°C.). A material having a thermal expansion coefficient similar to the above-mentioned value is 50% Ni—Fe alloy. By such a configuration, the plastic deformation of the shadow mask in the heat treatment can be prevented. Thus, the reduction of the tension applied to the shadow mask 3 due to the plastic deformation of the shadow mask 3 can be prevented.

In the above-mentioned sixth embodiment, the slit is provided at each corner of the frame 4. However, it is possible that the slit is provided in a middle portion of each side.

The invention may be embodied in other specific forms without departing from the spirit and scope thereof. The embodiments are to be considered in all respects as illustrative and not restrictive. The scope of the invention is indicated by the appended claims rather than by the foregoing description, and all changes which come within the meaning and range of equivalency of the claims are intended to be embraced therein.

What is claimed is:

1. A color cathode ray tube apparatus comprising a funnel, a panel, a phosphor screen disposed inside of said panel, a shadow mask disposed in the vicinity of said phosphor screen, a frame on which said shadow mask is fixed and an electron gun disposed in a neck part of said funnel, and wherein said frame has a shadow mask welding face which has a substantially rectangular shape defined by opposed pairs of longer and shorter sides, side walls which are continuously formed along an inner periphery of said shadow mask welding face and are substantially perpendicular to said shadow mask welding face, and a flange face which is formed along said side walls and is substantially parallel to said shadow mask welding face;

said shadow mask is fixed on the longer sides and shorter sides of said shadow mask welding face of said frame by welding under a condition that a predetermined tension is applied to said shadow mask; and a mechanical strength of the longer sides of said frame is higher than that of the shorter sides of said frame.

2. The color cathode ray tube apparatus in accordance with claim 1, wherein a reinforcing member is provided on each of the longer sides of said frame.

3. The color cathode ray tube apparatus in accordance with claim 2, wherein said reinforcing member is a rectangular plate which is fixed on said flange face of said frame.

4. The color cathode ray tube apparatus in accordance with claim 2, wherein said reinforcing member is a rectangular plate which is obliquely fixed between said side wall and said flange face of said frame.

5. The color cathode ray tube apparatus in accordance with claim 2, wherein said reinforcing member is a substantially triangle shaped plate which is fixed between said side wall and said flange face and oriented substantially perpendicular to said shadow mask welding face.

6. The color cathode ray tube apparatus in accordance with claim 1, wherein a reinforcing member is provided on each of the longer sides and shorter sides of said frame, and at least one of shape, thickness, number and material of said reinforcing members provided on the longer sides is different from that of said reinforcing members provided on the shorter sides.

7. The color cathode ray tube apparatus in accordance with claim 6, wherein said reinforcing member is a rectangular plate which is fixed on said flange face of said frame.

8. The color cathode ray tube apparatus in accordance with claim 6, wherein said reinforcing member is a rectangular plate which is obliquely fixed between said side wall and said flange face of said frame.

9. The color cathode ray tube apparatus in accordance with claim 6, wherein said reinforcing member is a substantially triangle shaped plate which is fixed between said side wall and said flange face and oriented substantially perpendicular to said shadow mask face.

10. The color cathode ray tube apparatus in accordance with claim 1, wherein a width of at least a part of said flange face on each longer side of said frame is wider than a width of said flange face on each shorter side of said frame.

11. The color cathode ray tube apparatus in accordance with claim 1, wherein said side wall on each longer side of said frame swells outward.

12. The color cathode ray tube apparatus in accordance with claim 1, wherein at least a part of said flange face on each shorter side of said frame is cut out.

13. The color cathode ray tube apparatus in accordance with claim 1, wherein a height of at least a part of the side wall on each shorter side of said frame is lower than that of the side wall on each longer side.

14. The color cathode ray tube apparatus in accordance with claim 1, wherein said longer sides and said shorter sides of said frame are respectively formed from independent first and second members, and a thickness of the first member for said longer side is larger than that of the second member for said shorter side.

15. The color cathode ray tube apparatus in accordance with claim 1, wherein said longer sides and said shorter sides of said frame are respectively formed from independent first and second members, and a material of the first member for said longer side is different from that of the second member for said shorter side.

16. The color cathode ray tube apparatus in accordance with claim 15, wherein Young's modulus of said material of said first member for said longer side is higher than that of said second member for said shorter side.

17. The color cathode ray tube apparatus in accordance with claim 16, wherein said thickness and the shape of the cross-section of said first member are the same as those of said second member.

18. The color cathode ray tube apparatus in accordance with claim 1, wherein a thermal expansion coefficient of a material of said frame is smaller than that of a material of said shadow mask.

19. A color cathode ray tube apparatus comprising a funnel, a panel, a phosphor screen disposed inside of said panel, a shadow mask disposed in the vicinity of said phosphor screen, a frame on which said shadow mask is fixed and an electron gun disposed in a neck part of said funnel, wherein said frame has a shadow mask welding face in which four sides thereof are continuously formed in a substantially rectangular shape defined by opposed pairs of longer and shorter sides, side walls which are continuously formed along an inner periphery of said shadow mask welding face and have alternately formed perpendicular portions and slanted portions, and a flange face which is formed along said side walls and is substantially parallel to said shadow mask welding face;

said perpendicular portions are substantially perpendicular to said shadow mask welding face and said slanted portions are formed to be slanted toward the inside of said frame; and said shadow mask is fixed on said shadow mask welding face of said frame by welding under a condition that a predetermined tension is applied to said shadow mask; and wherein ridge lines of said slanted portions of said side walls are substantially parallel to the sides of said shadow mask welding face, and said slanted portion, said perpendicular portion of said side wall and said flange face define an opening having a substantially triangular shape on a plane perpendicular to said shadow mask welding face.

20. The color cathode ray tube apparatus in accordance with claim 19, wherein at least one of the number and dimension of said perpendicular portion and said slanted portion of said side walls on said longer sides is different from that on said shorter sides.

21. The color cathode ray tube apparatus in accordance with claim 19, wherein a cross-sectional shape of said side walls of said frame in the vicinity of a boundary between said shadow mask welding face and said side walls on a plane parallel to said shadow mask welding face is substantially octagonal.

22. The color cathode ray tube apparatus in accordance with claim 19, wherein said frame is integrally formed by press working.

23. The color cathode ray tube apparatus in accordance with claim 19, wherein a thermal expansion coefficient of a material of said frame is smaller than that of a material of said shadow mask.

24. A color cathode ray tube apparatus comprising a funnel, a panel, a phosphor screen disposed inside of said panel, a shadow mask disposed in the vicinity of said phosphor screen, a frame on which said shadow mask is fixed and an electron gun disposed in a neck part of said funnel, wherein said frame has a shadow mask welding face in which four sides thereof are continuously formed in a substantially rectangular shape defined by opposed pairs of longer and shorter sides, side walls which are continuously formed along an inner periphery of said shadow mask welding face and have alternately formed perpendicular portions and first and second slanted portions, and a flange face which is formed along said side walls and is substantially parallel to said shadow mask welding face;

said perpendicular portions are substantially perpendicular to said shadow mask welding face and said first slanted portions are formed to be slanted to the inside of said frame, and said second slanted portions are formed to be slanted to the outside of said frame; and said shadow mask is fixed on the longer sides and shorter sides of said shadow mask welding face of said frame by welding under a condition that a predetermined tension is applied to said shadow mask.

25. The color cathode ray tube apparatus in accordance with claim 24, wherein ridge lines of said side walls and said shadow mask welding face are straight lines, and ridge lines of said side walls and said flange face are wave forms.

26. The color cathode ray tube apparatus in accordance with claim 24, wherein a cross-sectional shape of said side walls of said frame in the vicinity of a boundary between said shadow mask welding face and said side walls on a plane parallel to said shadow mask welding face is substantially octagonal.

27. The color cathode ray tube apparatus in accordance with claim 24, wherein said frame is integrally formed by press working.

28. The color cathode ray tube apparatus in accordance with claim 24, wherein a thermal expansion coefficient of a material of said frame is smaller than that of a material of said shadow mask.

29. A color cathode ray tube apparatus comprising a funnel, a panel, a phosphor screen disposed inside of said panel, a shadow mask disposed in the vicinity of said phosphor screen, a frame on which said shadow mask is fixed and an electron gun disposed in a neck part of said funnel, wherein said frame has a shadow mask welding face in which four sides thereof are continuously formed in a substantially rectangular shape defined by opposed pairs of longer and shorter sides, side walls which are continuously formed along an inner periphery of said shadow mask welding face and a flange face which is formed along said side walls and is substantially parallel to said shadow mask welding face;

said shadow mask is fixed on the longer sides and shorter sides of said frame under a condition that a predetermined tension is applied to said shadow mask;

said frame is made of a material having a thermal expansion coefficient smaller than that of a material of said shadow mask; and when the thermal expansion coefficient of the material of said frame is $\alpha_F$ (1/°C.), the temperature rise of said shadow mask from a normal temperature during operation of said color cathode ray tube apparatus is $\Delta t_o$ (°C.), the temperature rise of the shadow mask in the heat treatment during the producing process of the color cathode ray tube apparatus is $\Delta t$ (°C.), the thermal expansion coefficient of the material of said shadow mask is $\alpha_M$ (1/°C.), Young's modulus of said material of said shadow mask at the normal temperature is $E_M$ (kg/mm$^2$), and said tension applied to said shadow mask is T (kg/mm$^2$), the equations of $$\alpha_F \leqq \alpha_M(1-(\Delta t_o/\Delta t))$$

$$T \geqq \alpha_M \cdot \Delta t_0 \cdot E_m$$

are satisfied.

30. The color cathode ray tube apparatus in accordance with claim 29, wherein a plurality of cuttings are formed on said shadow mask welding face, said side walls of said frame have elasticity in a direction outward and inward with respect to the frame, and said predetermined tension is applied to said shadow mask by the elastic restoring force of said side walls of said frame.

* * * * *